US010490947B2

(12) United States Patent
Huang

(10) Patent No.: US 10,490,947 B2
(45) Date of Patent: Nov. 26, 2019

(54) ELECTRICAL CONNECTOR

(71) Applicant: LOTES CO., LTD, Keelung (TW)

(72) Inventor: Zhen Shan Huang, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 16/185,277

(22) Filed: Nov. 9, 2018

(65) Prior Publication Data

US 2019/0148888 A1 May 16, 2019

(30) Foreign Application Priority Data

Nov. 10, 2017 (CN) ..... 2017 1 1102173

(51) Int. Cl.
*H01R 13/424* (2006.01)
*H01R 13/6585* (2011.01)
*H01R 13/502* (2006.01)

(52) U.S. Cl.
CPC ..... *H01R 13/6585* (2013.01); *H01R 13/424* (2013.01); *H01R 13/5025* (2013.01)

(58) Field of Classification Search
CPC ..... H01R 13/6585; H01R 13/6597; H01R 13/424; H01R 13/5025
See application file for complete search history.

(56) References Cited

U.S. PATENT DOCUMENTS

2015/0194770 A1* 7/2015 Little ..... H01R 13/6582 439/607.27
2015/0207280 A1* 7/2015 Little ..... H01R 24/60 439/607.34
2016/0118752 A1* 4/2016 Guo ..... H01R 13/6585 439/78
2016/0149350 A1* 5/2016 Kao ..... H01R 12/724 439/607.05
2017/0187140 A1* 6/2017 Tsai ..... H01R 13/521
2017/0194748 A1* 7/2017 Peng ..... H01R 13/6581
2017/0201053 A1* 7/2017 Guo ..... H01R 12/75
2017/0271821 A1* 9/2017 Xie ..... H01R 13/6594
2017/0365954 A1* 12/2017 Chen ..... H01R 13/6461
2018/0145455 A1* 5/2018 Ju ..... H01R 13/631

FOREIGN PATENT DOCUMENTS

CN 105356163 A 2/2016
CN 205452703 U 8/2016
CN 106856284 A 6/2017
CN 107017491 A 8/2017
CN 206461183 U 9/2017

* cited by examiner

*Primary Examiner* — Truc T Nguyen
(74) *Attorney, Agent, or Firm* — Locke Lord LLP; Tim Tingkang Xia, Esq.

(57) ABSTRACT

An electrical connector used for mating with a mating connector includes: an insulating body, having a base and a tongue extending from the base; a metal shell, wrapping the insulating body and forming a mating cavity with the tongue; two rows of terminals, fixedly disposed on the insulating body and exposed on the tongue, one of the two rows of terminals having at least one ground terminal; and a middle shielding sheet, disposed on the insulating body and located between the two rows of terminals. Each of the at least one ground terminal has an extending portion, and the extending portion extends away from the middle shielding sheet and abuts the metal shell.

20 Claims, 8 Drawing Sheets

A

A-A

A

ELECTRICAL CONNECTOR

CROSS-REFERENCE TO RELATED PATENT APPLICATION

This non-provisional application claims priority to and the benefit of, pursuant to 35 U.S.C. § 119(a), patent application Serial No. CN201711102173.4 filed in China on Nov. 10, 2017. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and more particularly to an electrical connector with a ground terminal urging a metal shell.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Conventionally, a electrical connector is mounted on a circuit board. The electrical connector includes an insulating body, and the insulating body has a base and a tongue extending from the base. Multiple terminals are fixedly disposed on the insulating body. The terminals form two rows of terminals which are disposed opposite to each other in a vertical direction, and each row of terminals is respectively exposed to the tongue. Two sides of each row of terminals respectively have a ground terminal. The ground terminals of the two rows of terminals are disposed opposite to each other in the vertical direction. The ground terminal of the upper row of terminals extends downward to form a first bending sheet, and the ground terminal of the lower row of terminals extends upward to form a second bending sheet. A middle shielding sheet is disposed between the two rows of terminals. The middle shielding sheet has a soldering leg which is soldered on the circuit board so as to be grounded, and the middle shielding sheet has multiple openings, which are used for buckling with the first bending sheet and the second bending sheet. The ground terminal of the upper row of terminals contacts the middle shielding sheet through the first bending sheet so as to enhance the grounding effect and improve the shielding effect, and the ground terminal of the lower row of terminals contacts the middle shielding sheet through the second bending sheet so as to enhance the grounding effect and improve the shielding effect.

However, a soldering portion of the middle shielding sheet may be poorly soldered or may be loosened, so that the grounding effect of the middle shielding sheet is poor, and the contact between the ground terminal and the middle shielding sheet cannot play a role in enhancing the grounding effect and improving the shielding effect.

Therefore, a heretofore unaddressed need to design a novel electrical connector exists in the art to address the aforementioned deficiencies and inadequacies.

SUMMARY

The present invention is directed to an electrical connector having a good grounding effect between ground terminals and a metal shell.

To achieve the foregoing objective, the present invention adopts the following technical solution: an electrical connector, configured to mate with a mating connector, includes: an insulating body, having a base and a tongue extending from the base; a metal shell, wrapping the insulating body and forming a mating cavity with the tongue; two rows of terminals, fixedly disposed on the insulating body and exposed on the tongue, wherein one of the two rows of terminals comprises at least one ground terminal; and a middle shielding sheet, disposed on the insulating body and located between the two rows of terminals, wherein each of the at least one ground terminal has an extending portion, and the extending portion extends away from the middle shielding sheet and abuts the metal shell.

In certain embodiments, each of the at least one ground terminal has a contact portion exposed on the tongue and a retaining portion extending from the contact portion and fixed on the base, the extending portion extends from the retaining portion and is exposed on the base, the metal shell partially covers the base, and the extending portion abuts a portion of the metal shell covering the base.

In certain embodiments, the metal shell has an inner surface, the inner surface faces and surrounds the insulating body, and the extending portion is in rigid contact with the inner surface.

In certain embodiments, an elastic buckling portion is formed on the inner surface, the insulating body is concavely provided with a buckling slot, and the elastic buckling portion enters the buckling slot; and the insulating body defines a width direction, and an abutting location between the extending portion and the inner surface is aligned to the elastic buckling portion in the width direction.

In certain embodiments, the metal shell has an inner surface, the inner surface faces and surrounds the insulating body, an elastic abutting arm is formed on the inner surface, and the elastic abutting arm extends toward the insulating body and elastically abuts the extending portion.

In certain embodiments, an elastic buckling portion is formed on an end of the elastic abutting arm, the insulating body is concavely provided with a buckling slot, and the elastic buckling portion enters the buckling slot.

In certain embodiments, the insulating body defines a width direction, and an abutting location between the elastic abutting arm and the extending portion is aligned to the elastic buckling portion in the width direction.

In certain embodiments, an abutting portion extends from the middle shielding sheet, an end of the abutting portion is in abutting contact with the metal shell, and a direction in which the abutting portion is in abutting contact with the metal shell and with a direction in which the extending portion is in abutting contact with the metal shell form an angle.

In certain embodiments, the end of the abutting portion has a strip connecting portion connected to a strip, a width of the strip connecting portion is smaller than the width of the abutting portion, and the strip connecting portion is provided to protrude out of other portions of the end of the abutting portion.

In certain embodiments, after the strip connecting portion is separated from the strip, a fracture surface is formed, and the fracture surface abuts the metal shell.

In certain embodiments, each of the at least one ground terminal has a retaining portion, the extending portion extends from the retaining portion, the middle shielding sheet defines a plane parallel to the retaining portion, and the extending portion is perpendicular to the plane and extends away from the plane to abut the metal shell. In certain embodiments, the extending portion has a contact end configured to contact the metal shell.

In certain embodiments, the one of the two rows of terminals comprises two ground terminals, the two ground terminals are located at two sides of the one of the two rows of terminals, and the extending portions of the two ground terminals extend toward a same direction.

In certain embodiments, the insulating body defines a width direction, and the extending portions of the two ground terminals are symmetrically disposed in the width direction.

In certain embodiments, each of the two rows of terminals respectively comprises a ground terminal, the ground terminals of the two rows of terminals are disposed opposite to each other, and the extending portions of the two ground terminals extend away from each other.

Compared with the related art, the ground terminal according to certain embodiments of the present invention is in direct abutting contact with the metal shell, thereby preventing from electrical disconnection between the ground terminal and the metal shell and disabling the ground terminal and the metal shell to form a grounding circuit due to poor soldering or loosening of the middle shielding sheet.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
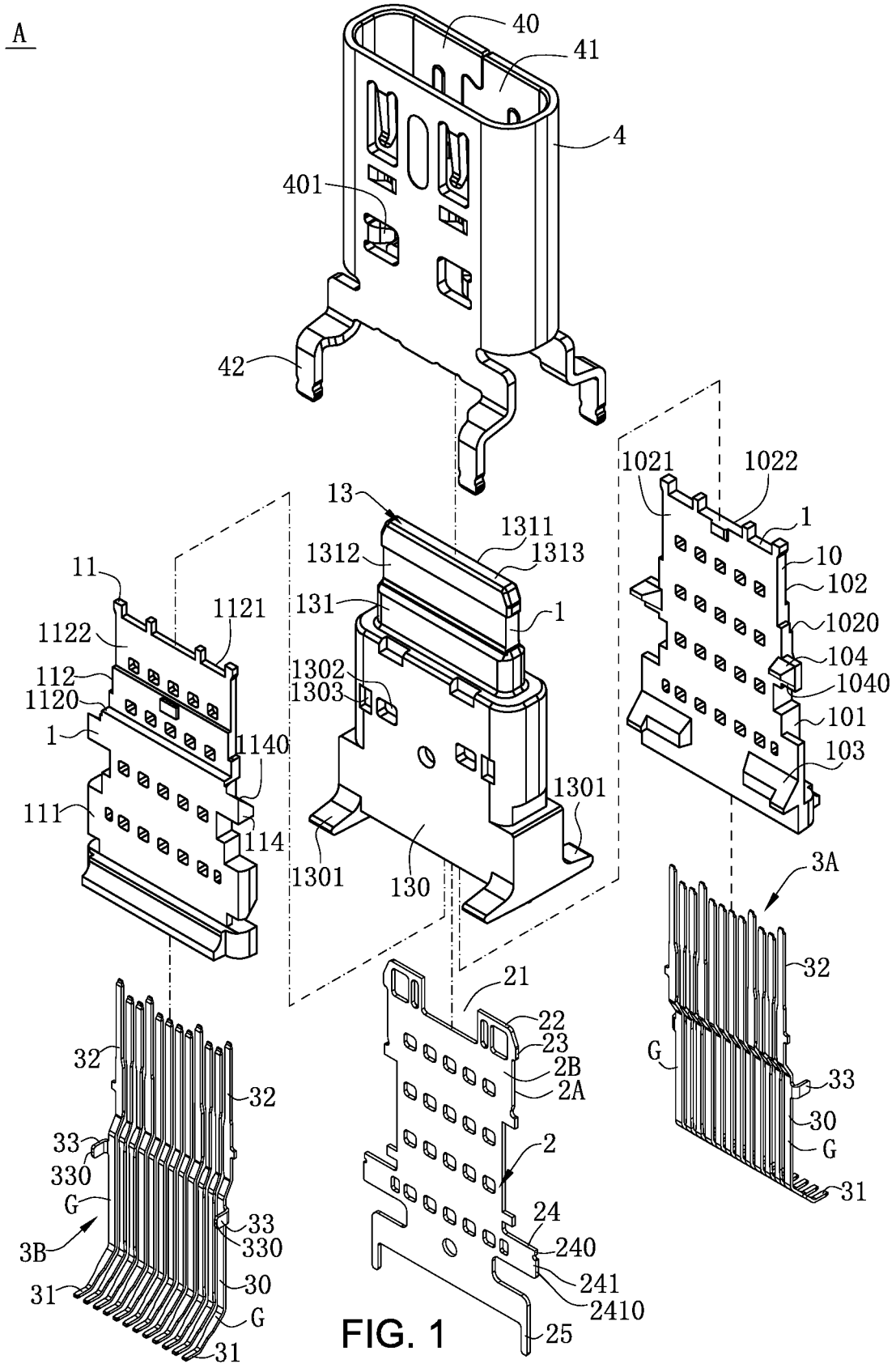
FIG. 1 is a perspective exploded view of an electrical connector according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-8. In accordance with the purposes of this invention, as embodied and broadly described herein, this invention, in one aspect, relates to an electrical connector.

Figure 2:
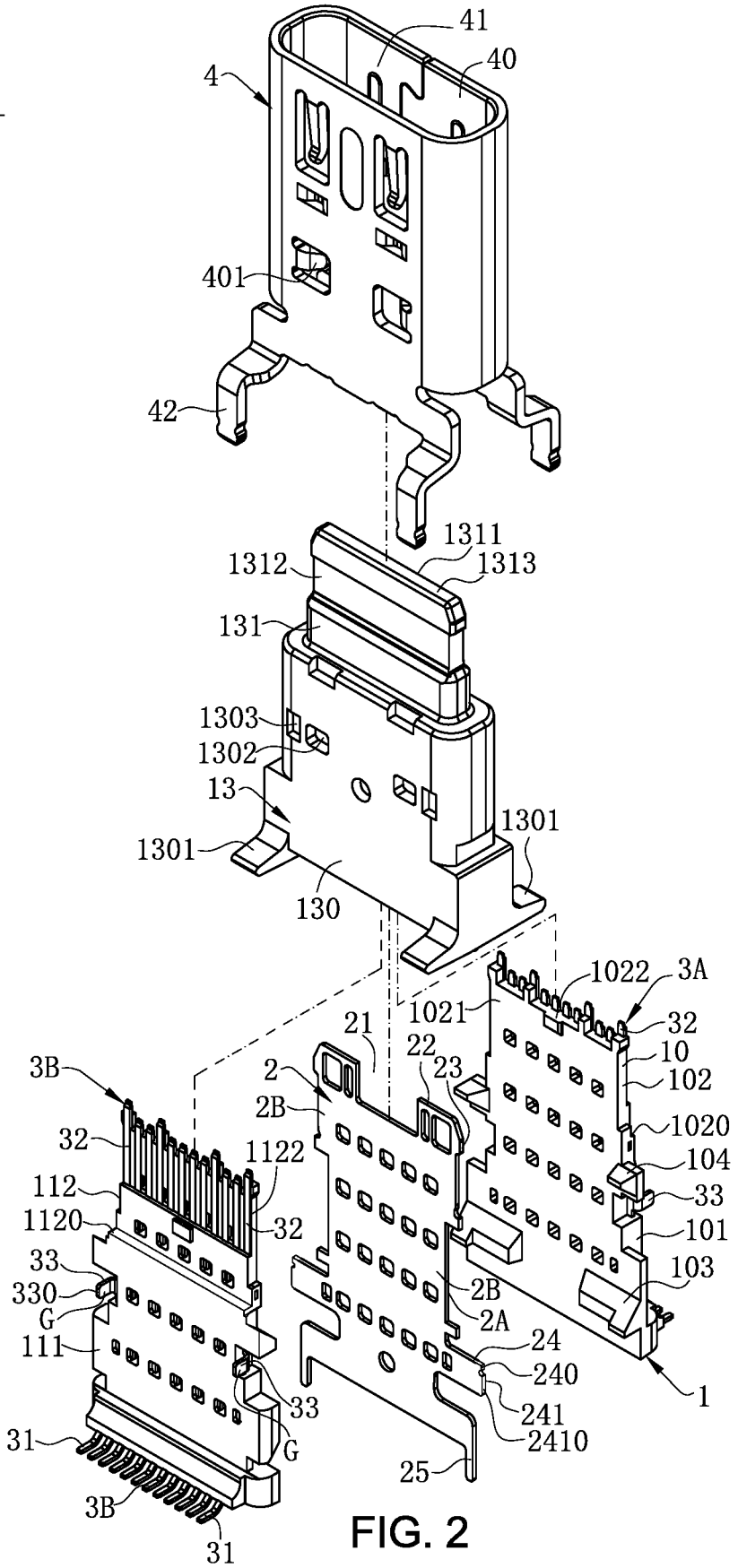
FIG. 2 is a perspective exploded view of the electrical connector of FIG. 1, where a terminal and an insulating block of the electrical connector are insert-molded.
Figure 3:
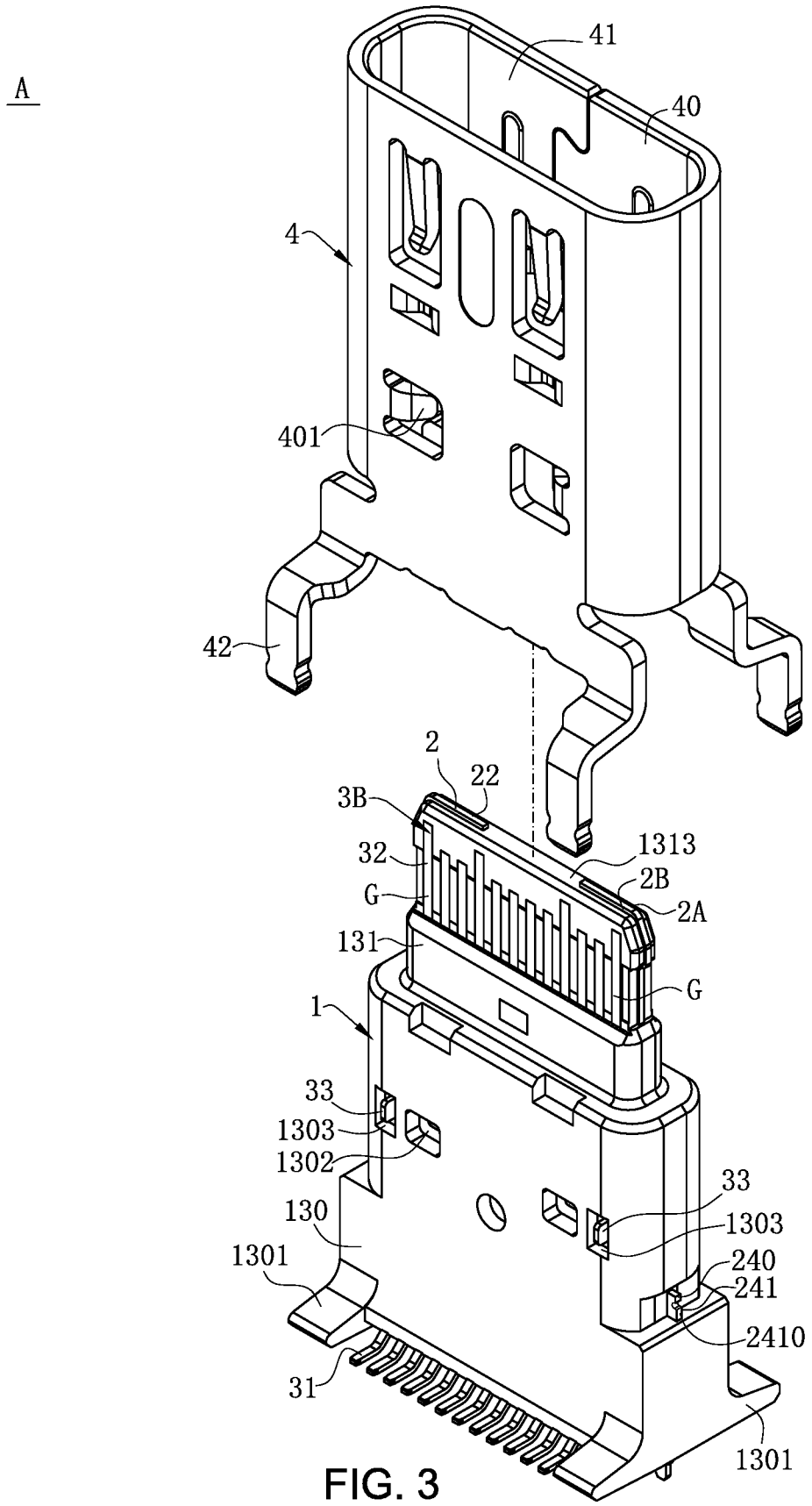
FIG. 3 is a perspective exploded view of the insulating body of FIG. 1 being insert-molded with the middle shielding sheet and the terminal, but not mounted with the metal shell.

Referring to FIG. 1, FIG. 2 and FIG. 3, which show a first embodiment of the present invention, an electrical connector A is perpendicularly mounted on a circuit board (not shown) from top to bottom, and the electrical connector A is used for accommodating a mating connector (not shown). The electrical connector A includes an insulating body 1; a first row of terminals 3A and a second row of terminals 3B which are disposed opposite to each other, where both the first row of terminals 3A and the second row of terminals 3B are respectively embedded in the insulating body 1; a middle shielding sheet 2 located between the two rows of terminals, and a metal shell 4 disposed in a cylindrical shape to wrap the insulating body 1.

Referring to FIG. 1, FIG. 2 and FIG. 3, the insulating body 1 includes a first insulating block 10 and a second insulating block 11, as well as an outer insulating block 13 covering the first insulating block 10 and the second insulating block 11. The first insulating block 10 is used for embedding and fixing the first row of terminals 3A and the middle shielding sheet 2, thereby forming a first module. The first insulating block 10 has a first substrate 101, and a first tongue sheet 102 extends upward from the first substrate 101. The first substrate 101 has a first step portion 1020 connected to the first tongue sheet 102. The first insulating block 10 defines a thickness direction and a width direction. The first insulating block 10 has a first vertical surface 1021, the first vertical surface 1021 is located on the first substrate 101 and the first tongue sheet 102. Two buckling blocks 103 are protrudingly provided on the first vertical surface 1021, and the buckling blocks 103 are located at two sides of the lower end of the first vertical surface 1021 along the width direction. Two sides of the first substrate 101 along the width direction are respectively protrudingly provided with two first fixing blocks 104, and the first fixing blocks 104 are located above the buckling blocks 103. Each first fixing block 104 has a first mating surface 1040 inclining downward. The first tongue sheet 102 has a first plate surface 1022 opposite to the first vertical surface 1021. The first row of terminals 3A is embedded in the first substrate 101, and extends upward out of the first tongue sheet 10 to be exposed on the first plate surface 1022 and extends downward out of the lower end of the first substrate 101. The middle shielding sheet 2 is located close to the first vertical surface 1021 with respect to the first row of terminals 3A. The middle shielding sheet 2 is disposed in a plate shape. A plate surface of the middle shielding sheet 2 is parallel to the first vertical surface 1021, and the middle shielding sheet 2 extends downward out of the lower end of the first substrate 101 and extends upward partially out of the first tongue sheet 102.

Referring to FIG. 1, FIG. 2 and FIG. 3, the second insulating block 11 is used for embedding and fixing the second row of terminals 3B, thereby forming a second module. The second insulating block 11 has a second substrate 111, and a second tongue sheet 112 extends upward from the second substrate 111. The second substrate 111 has a second step portion 1120 to be connected to the second tongue sheet 112. The second insulating block 11 defines a thickness direction and a width direction. The second insulating block 11 has a second vertical surface 1121, and two sides of the second vertical surface 1121 along the width direction are respectively concavely provided with two buckling slots (not shown). Two sides of the second insulating block 11 along the width direction respectively extend outward to form two second fixing blocks 114, and the second fixing blocks 114 are located above the buckling slots (not shown). Each second fixing block 114 has a second mating surface 1140 inclining upward, which is used for being matched with the first mating surface 1040. The second tongue sheet 112 has a second plate surface 1122 opposite to the second vertical surface 1121 in the thickness direction. The second row of terminals 3B is embedded in the second substrate 111, and extends upward out of the second tongue sheet 112 to be exposed on the second plate surface 1122 and extends downward out of the lower end of the second substrate 111.

Referring to FIG. 2 and FIG. 3, the first module is closely laminated to and matched with the second module. The buckling blocks 103 enter the buckling slots (not shown). The first vertical surface 1021 is laminated to the second vertical surface 1121; and the first step portion 1020 and the second step portion 1120 are disposed opposite to each other. The first mating surface 1040 and the second mating surface 1140 are closely matched with each other, so that the first fixing blocks 104 and the second fixing blocks 114 are fixed together. Since the first mating surface 1040 and the second mating surface 1140 are provided to be inclined corresponding to each other, the first module and the second module can be mounted more conveniently in the mounting process. The middle shielding sheet 2 is located between the first row of terminals 3A and the second row of terminals 3B.

Figure 4:
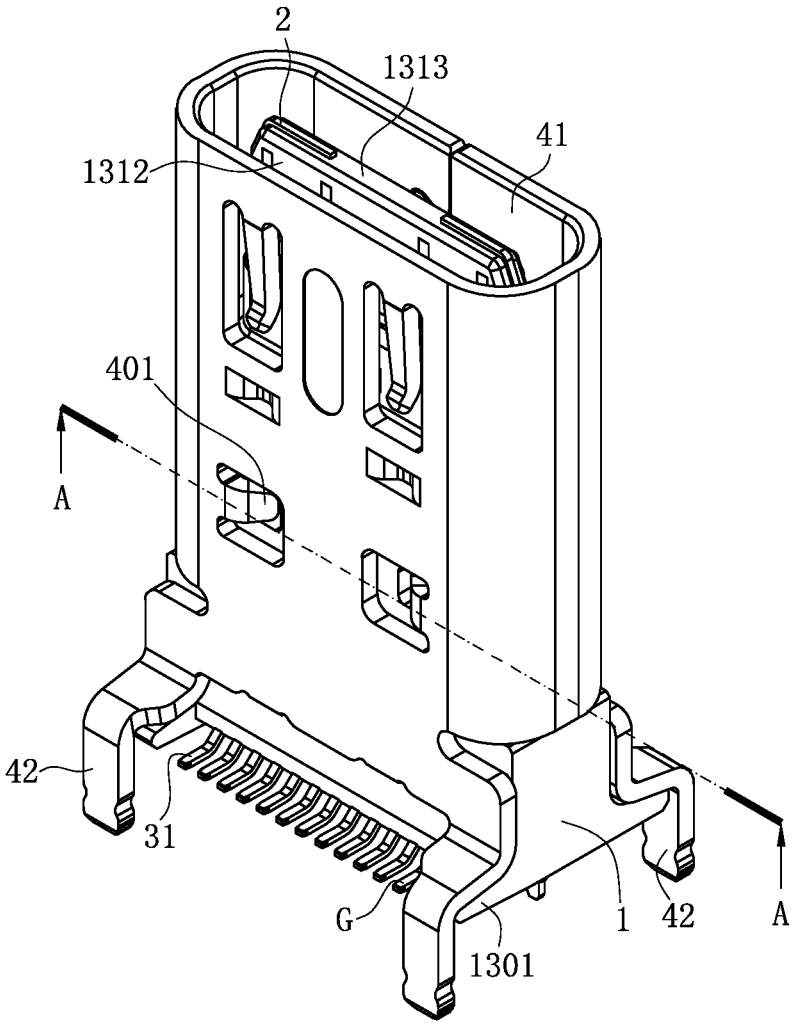
FIG. 4 is a perspective view of the metal shell of FIG. 3 being mounted on the insulating body.
Figure 5:
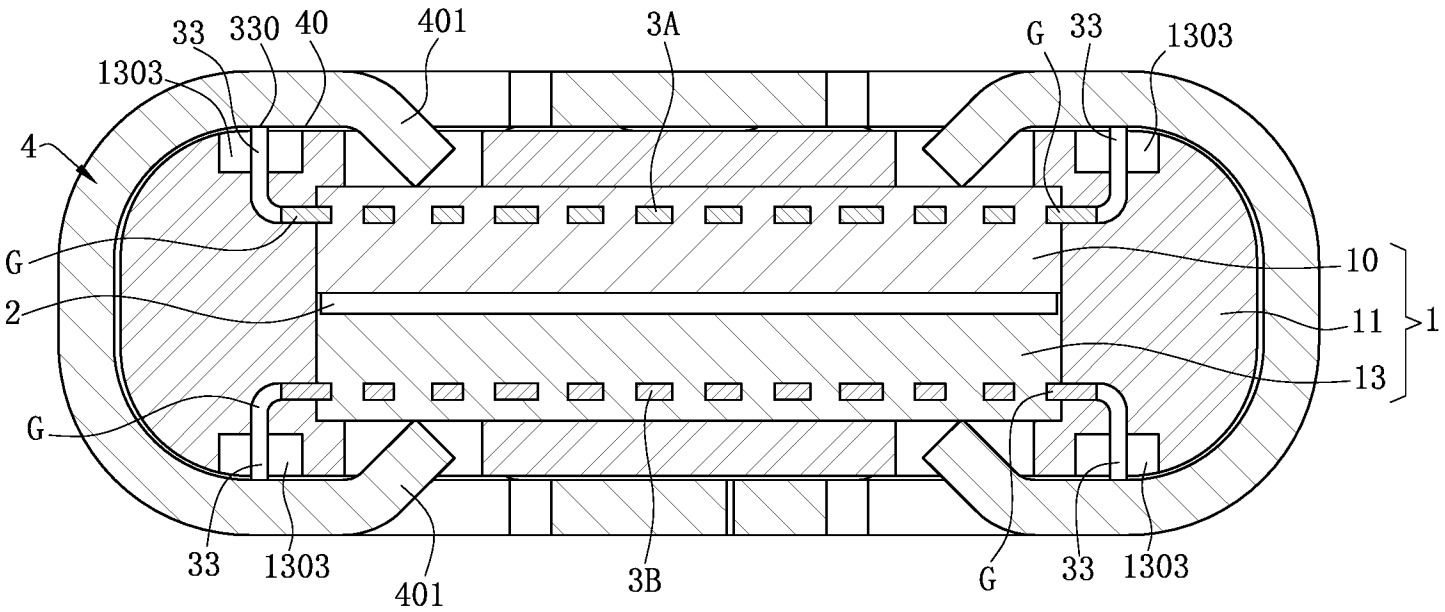
FIG. 5 is a plain sectional view along line A-A in FIG. 4, where a sectional surface along the line A-A passes through an elastic buckling portion of the metal shell.

Referring to FIG. 2, FIG. 3 and FIG. 4, the outer insulating block 13 is used for covering the first module and the second module so as to form the insulating body 1. The outer insulating block 13 covers the first substrate 101 and the second substrate 111 to form a base 130 of the insulating body 1. Further, two sides of the lower end of the base 130 are provided with two supporting legs 1301, which are mounted on the circuit board (not shown) in a supporting manner. The base 130 is concavely provided with multiple buckling slots 1302 and multiple accommodating grooves 1303. The buckling slot 1302 is used for being fixedly matched with the metal shell 4. The accommodating groove 1303 is used for accommodating the extending portion 33. The buckling slot 1302 and the accommodating groove 1303 located on a same surface are aligned to each other along the width direction of the insulating body 1. The outer insulating block 13 covers the first tongue sheet 102 and the second tongue sheet 112, thereby forming a tongue 131 of the insulating body 1, where the tongue 131 is formed by extending upward from the base 130. The tongue 131 has a first surface 1311 and a second surface 1312 disposed opposite to each other. The first surface 1311 is flush with the first plate surface 1022, and the second surface 1312 is flush with the second plate surface 1122. The upper end of the tongue 131 has a third surface 1313, and the third surface 1313 is connected to the first surface 1311 and the second surface 1312. The upper end of the middle shielding sheet 2 partially extends out of the third surface 1313; and the lower end of the middle shielding sheet 2 downwardly extends out of the base 130. The upper ends of the first row of terminals 3A and the second row of terminals 3B are embedded in the tongue 131, and the first row of terminals 3A and the second row of terminals 3B are partially exposed on the first surface 1311 and the second surface 1312 of the tongue 131, which are opposite to each other.

The middle shielding sheet 2 has two planes, and the two planes are formed by a first plane 2A and a second plane 2B which are parallel to each other in the thickness direction. The first plane 2A and the second plane 2B are plate surfaces of the middle shielding sheet 2, and the first plane 2A is flush with the first vertical surface 1021. The first plane 2A is relatively close to the first row of terminals 3A, and the second plane 2B is relatively close to the second row of terminals 3B.

The upper end of the middle shielding sheet 2 is concavely provided with a middle groove 21. The middle groove 21 corresponds to terminals in a middle portion of the first row of terminals 3A and terminals in a middle portion of the second row of terminals 3B. Two sides of the middle groove 21 respectively form two upper protruding portions 22; and the two upper protruding portions 22 protrude out of a bottom edge of the middle groove 21. The two upper protruding portions 22 extend out of the third surface 1313, and the upper protruding portions 22 protrude upward to be exposed to two sides of the tongue 131 in the width direction, thereby forming a latch portion 23. The latch portion 23 is used for latching the mating connector (not shown). Two sides of the middle-lower end of the middle shielding sheet 2 respectively extend outward to form two abutting portions 24. Each abutting portion 24 has an abutting end 240, and the abutting end 240 protrudes out of the base 130 in the width direction to abut the metal shell 4. The abutting end 240 has a strip connecting portion 241 which is used for connecting a strip (not shown), and the width of the strip connecting portion 241 is smaller than the width of the abutting end 240, thus reducing burrs on the abutting end 240, so that the contact between the abutting end 240 and the metal shell 4 is better. The strip connecting portion 241 protrudes out of other portions of the abutting end 240. A fracture surface 2410 is formed after the strip connecting portion 241 is separated from the strip (not shown), and the fracture surface 2410 abuts the metal shell 4. The lower end of the middle shielding sheet 2 extends to form a connection portion 25, and the connection portion 25 extends downward out of the lower end of the base 130 to be connected to a grounding circuit of the circuit board (not shown).

The first row of terminals 3A and the second row of terminals 3B are symmetrically disposed, and each row of terminals has 12 terminals conforming to the USB type C specification. Each of the terminals in the first row of terminals 3A and the second row of terminals 3B has a retaining portion 30, and the retaining portion 30 is embedded in the base 130. A soldering portion 31 extends downward from the retaining portion 30. The soldering portion 31 extends downward out of the base 130 and is used for being soldered and mounted on the circuit board (not shown), and all soldering portions 31 are located between two supporting legs 1301. A contact portion 32 extends upward from the retaining portion 30; and the contact portion 32 is disposed on the tongue 131 and partially exposed to the tongue 131. The end of the contact portion 32 is embedded in the tongue 131, thereby facilitating the fixation of the contact portion 32. Each retaining portion 30 and each contact portion 32 are parallel to the first plane 2A. Two sides of each row of terminals are respectively provided with two ground terminals G. The retaining portion 30 of each ground terminal G bends and extends away from and is perpendicular to the first plane 2A to form an extending portion 33. The extending portion 33 protrudes into the accommodating groove 1303 and is exposed to outside. The extending portion 33 is located above the abutting portion 24. The side wall of the accommodating groove 1303 has a gap with the extending portion 33, so that the accommodating groove 1303 can provide a space for the movement of the extending portion 33, thereby preventing from poor contact caused by the incapability of movement of the extending portion 33 and the metal shell 4 when the extending portion 33 and the metal shell 4 are in rigid abutting contact with each other. The extending portion 33 has a contact end 330, and the contact end 330 is a free end of the extending portion 33, which extends out of the accommodating groove 1303 and is used for rigidly abutting the metal shell 4 in the thickness direction of the insulating body 1. Two extending portions 33 of the first row of terminals 3A extend along a same direction and are symmetrically disposed.

The second row of terminals 3B has a same structure with the first row of terminals 3A, and is symmetrical with the first row of terminals 3A, which is used for enabling the electrical connector A to allow the forward and reverse insert. The extending portion 33 of the first row of terminals 3A and the extending portion 33 of the second row of terminals 3B abut the metal shell 4 in opposite directions, so that the ground terminals G form multiple contact points with the metal shell 4, thereby ensuring the grounding effect and enhancing the shielding effect.

The metal shell 4 is in a cylindrical shape and surrounds the insulating body 1. The metal shell 4 has a soldering leg 42, and the soldering leg 42 is connected to a grounding circuit of the circuit board (not shown). The metal shell 4 has an inner surface 40, and the inner surface 40 faces the insulating body 1. The lower end of the inner surface 40 surrounds and covers the base 130, and the upper end of the inner surface 40 and the tongue 131 form a mating cavity 41 used for accommodating the mating connector (not shown). The contact end 330 rigidly abuts the inner surface 40 in the thickness direction of the insulating body 1. The abutting end 240 rigidly abuts the inner surface 40 in the width direction of the insulating body 1, so that the extending portion 33 and the abutting portion 24 are in abutting contact with the metal shell 4 in different directions, and the metal shell 4 is enabled to form multiple contact points with the ground terminals G and the middle shielding sheet 2, thereby improving the grounding effect and enhancing the shielding effect. Meanwhile, the ground terminals G are in direct abutting contact with the metal shell 4, thereby preventing from electrical disconnection between the ground terminals G and the metal shell 4 and disabling the ground terminals G and the metal shell 4 to form a grounding circuit due to poor soldering or loosening of the middle shielding sheet 2.

The inner surface 40 is torn to form an elastic buckling portion 401. The elastic buckling portion 401 is buckled with the buckling slot 1302 to fix the metal shell 4 on the insulating body 1, where the elastic buckling portion 401 is aligned to the extending portion 33 in the width direction of the insulating body 1, so that the abutting between the inner surface 40 and the contact end 330 is more stable.

Figure 6:
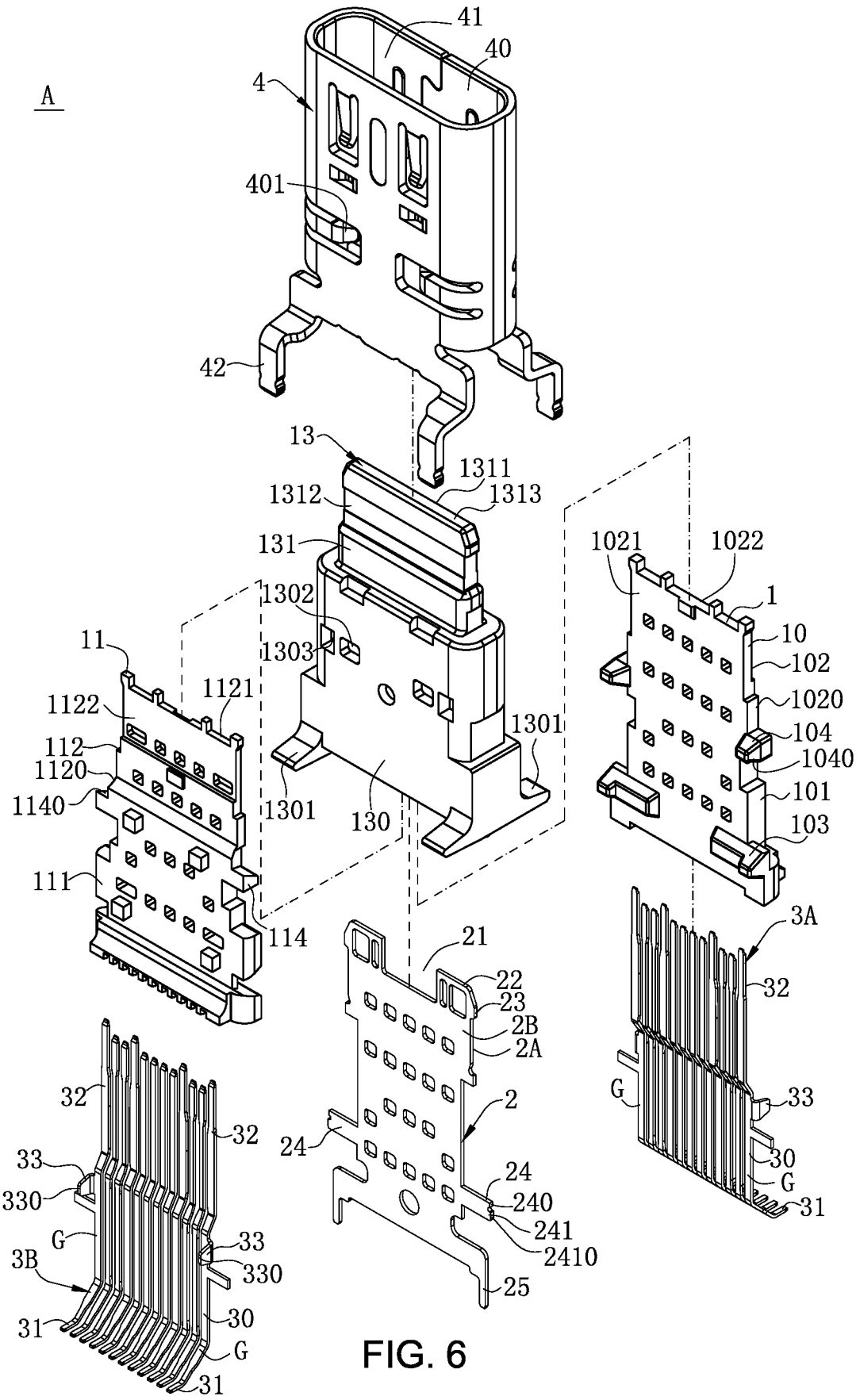
FIG. 6 is a perspective exploded view of the electrical connector according to a second embodiment of the present invention.
Figure 7:
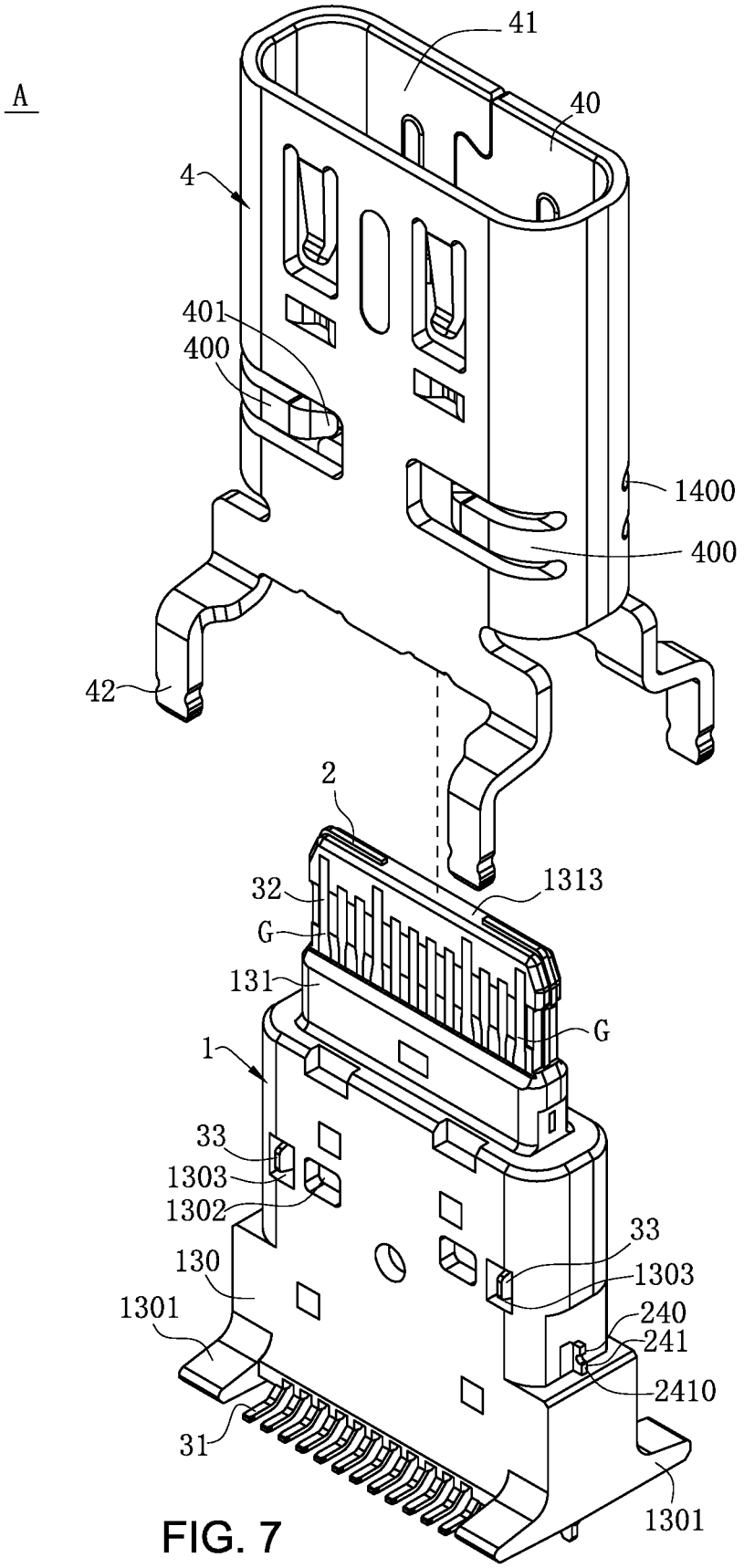
FIG. 7 is a perspective exploded view of the insulating body of FIG. 6 being insert-molded with the middle shielding sheet and the terminal, but not mounted with the metal shell.
Figure 8:
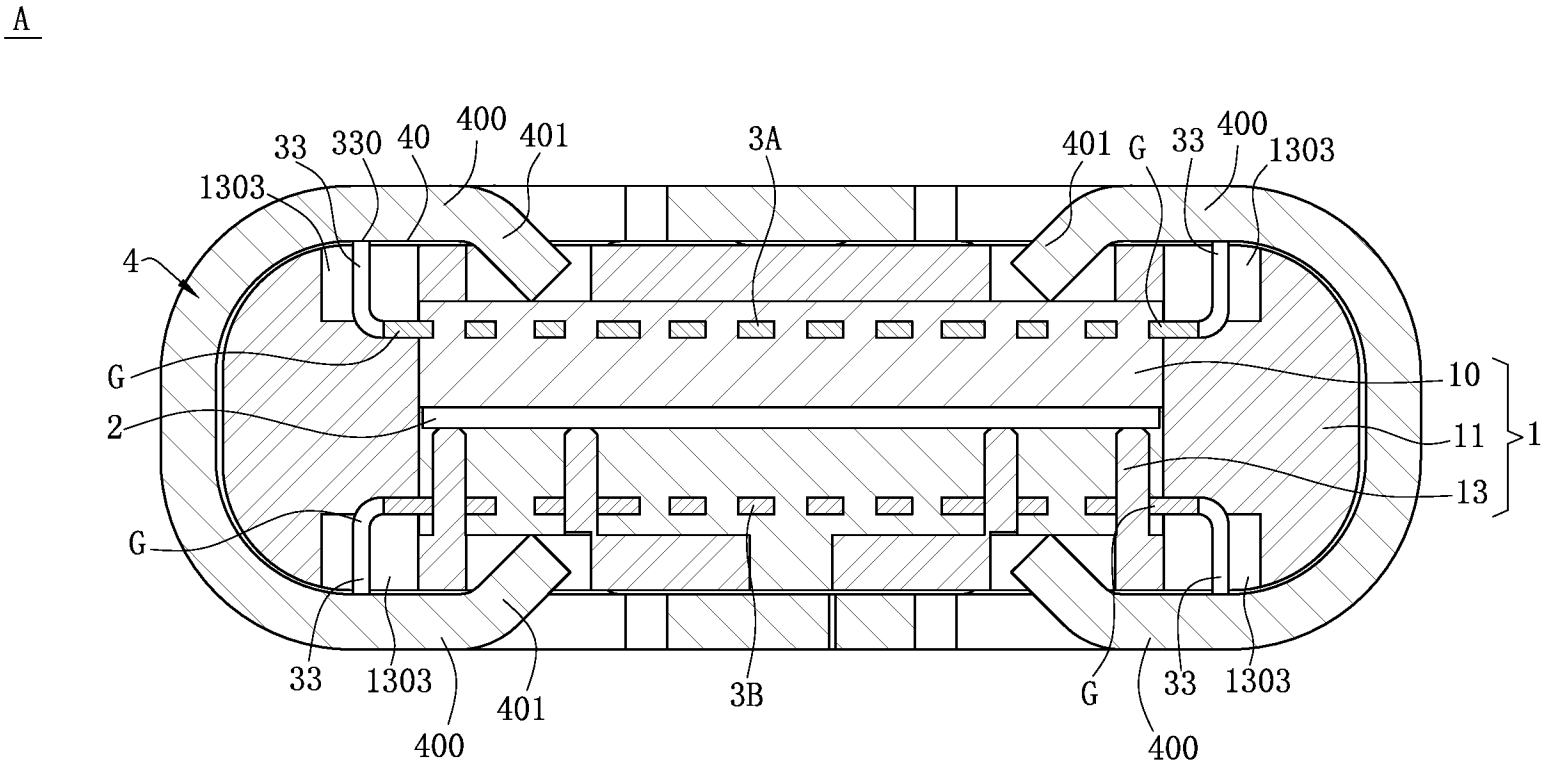
FIG. 8 is a plain sectional view of the metal shell of FIG. 7 being mounted on the insulating body in which the metal shell of FIG. 7, where a sectional line passes through an elastic abutting arm.

Referring to FIG. 6, FIG. 7 and FIG. 8, which show a second embodiment of the present invention. The second embodiment differs from the first embodiment in that: an elastic abutting arm 400 is formed from the inner surface 40, and the elastic abutting arm 400 is in elastic abutting contact with the extending portion 33, so that a contact effect between the extending portion 33 and the metal shell 4 is good, and the shielding effect of the electrical connector A is better facilitated. The end of the elastic abutting arm 400 extends toward the insulating body 1 to form an elastic buckling portion 401, and the elastic buckling portion 401 is buckled with the buckling slot 1302, thereby not only facilitating the fixation of the metal shell 4 on the insulating body 1, but also facilitating the contact stability between the elastic abutting arm 400 and the extending portion 33.

To sum up, the electrical connector according to certain embodiments of the present invention has the following beneficial effects:

1. The ground terminals G are in direct abutting contact with the metal shell 4, thereby preventing from electrical disconnection between the ground terminals G and the metal shell 4 and disabling the ground terminals G and the metal shell 4 to form a grounding circuit due to poor soldering or loosening of the middle shielding sheet 2.

2. The contact end 330 rigidly abuts the inner surface 40 in the thickness direction of the insulating body 1. The abutting end 240 rigidly abuts the inner surface 40 in the width direction of the insulating body 1, so that the extending portion 33 and the abutting portion 24 are in abutting contact with the metal shell 4 in different directions, and the metal shell 4 is enabled to form multiple contact points with the ground terminals G and the middle shielding sheet 2, thereby improving the grounding effect and enhancing the shielding effect.

3. The extending portion 33 protrudes into the accommodating groove 1303 and is exposed to outside. The side wall of the accommodating groove 1303 has a gap with the extending portion 33, so that the accommodating groove 1303 can provide a space for the movement of the extending portion 33, thereby preventing from poor contact caused by the incapability of movement of the extending portion 33 and the metal shell 4 when the extending portion 33 and the metal shell 4 are in rigid abutting contact with each other.

4. The abutting end 240 has a strip connecting portion 241 which is used for connecting a strip, and the width of the strip connecting portion 241 is smaller than the width of the end of the abutting portion 24, thus reducing burrs on the abutting end 240, so that the contact between the abutting end 240 and the metal shell 4 is better.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, configured to mate with a mating connector, and comprising:

an insulating body, having a base and a tongue extending from the base;

a metal shell, wrapping the insulating body and forming a mating cavity with the tongue, wherein the metal shell has an inner surface facing and surrounding the insulating body, and an elastic abutting arm is formed on the inner surface;

two rows of terminals, fixedly disposed on the insulating body and exposed on the tongue, wherein one of the two rows of terminals comprises at least one ground terminal; and a middle shielding sheet, disposed on the insulating body and located between the two rows of terminals, wherein each of the at least one ground terminal has an extending portion, the extending portion extends away from the middle shielding sheet and abuts the metal shell, and the elastic abutting arm extends toward the insulating body and elastically abuts the extending portion.

2. The electrical connector according to claim 1, wherein an elastic buckling portion is formed on an end of the elastic abutting arm, the insulating body is concavely provided with a buckling slot, and the elastic buckling portion enters the buckling slot.

3. The electrical connector according to claim 2, wherein the insulating body defines a width direction, and an abutting location between the elastic abutting arm and the extending portion and the elastic buckling portion are located on a horizontal sectional plane extending in the width direction.

4. The electrical connector according to claim 1, wherein an abutting portion extends from the middle shielding sheet, an end of the abutting portion is in abutting contact with the metal shell, and a direction in which the abutting portion is in abutting contact with the metal shell and with a direction in which the extending portion is in abutting contact with the metal shell form an angle greater than 0°.

5. The electrical connector according to claim 4, wherein the end of the abutting portion has a strip connecting portion connected to a strip, a width of the strip connecting portion is smaller than the width of the abutting portion, and the strip connecting portion is provided to protrude out of other portions of the end of the abutting portion.

6. The electrical connector according to claim 5, wherein after the strip connecting portion is separated from the strip, a fracture surface is formed, and the fracture surface abuts the metal shell.

7. The electrical connector according to claim 1, wherein each of the at least one ground terminal has a retaining portion, the extending portion extends from the retaining portion, the middle shielding sheet defines a plane parallel to the retaining portion, and the extending portion is perpendicular to the plane and extends away from the plane to abut the metal shell.

8. The electrical connector according to claim 1, wherein the one of the two rows of terminals comprises two ground terminals, the two ground terminals are located at two sides of the one of the two rows of terminals, and the extending portions of the two ground terminals extend toward a same direction.

9. An electrical connector, configured to mate with a mating connector, and comprising:

an insulating body, having a base and a tongue extending from the base;

a metal shell, wrapping the insulating body and forming a mating cavity with the tongue;

two rows of terminals, fixedly disposed on the insulating body and exposed on the tongue, wherein one of the two rows of terminals comprises at least one ground terminal; and a middle shielding sheet, disposed on the insulating body and located between the two rows of terminals, wherein an abutting portion extends from the middle shielding sheet, an end of the abutting portion is in abutting contact with the metal shell, the end of the abutting portion has a strip connecting portion connected to a strip, a width of the strip connecting portion is smaller than the width of the abutting portion, and the strip connecting portion is provided to protrude out of other portions of the end of the abutting portion, wherein each of the at least one ground terminal has an extending portion, the extending portion extends away from the middle shielding sheet and abuts the metal shell, and a direction in which the abutting portion is in abutting contact with the metal shell and a direction in which the extending portion is in abutting contact with the metal shell form an angle.

10. The electrical connector according to claim 9, wherein:

the metal shell has an inner surface facing and surrounding the insulating body, an elastic buckling portion is formed on the inner surface, the insulating body is concavely provided with a buckling slot, and the elastic buckling portion enters the buckling slot; and the insulating body defines a width direction, and an abutting location between the extending portion and the inner surface is aligned to the elastic buckling portion in the width direction.

11. The electrical connector according to claim 9, wherein the metal shell has an inner surface, the inner surface faces and surrounds the insulating body, an elastic abutting arm is formed on the inner surface, and the elastic abutting arm extends toward the insulating body and elastically abuts the extending portion.

12. The electrical connector according to claim 11, wherein an elastic buckling portion is formed on an end of the elastic abutting arm, the insulating body is concavely provided with a buckling slot, and the elastic buckling portion enters the buckling slot.

13. The electrical connector according to claim 9, wherein after the strip connecting portion is separated from the strip, a fracture surface is formed, and the fracture surface abuts the metal shell.

14. The electrical connector according to claim 9, wherein each of the at least one ground terminal has a retaining portion, the extending portion extends from the retaining portion, the middle shielding sheet defines a plane parallel to the retaining portion, and the extending portion is perpendicular to the plane and extends away from the plane to abut the metal shell.

15. The electrical connector according to claim 9, wherein the one of the two rows of terminals comprises two ground terminals, the two ground terminals are located at two sides of the one of the two rows of terminals, and the extending portions of the two ground terminals extend toward a same direction.

16. An electrical connector, configured to mate with a mating connector, and comprising:

an insulating body, having a base and a tongue extending from the base;

a metal shell, wrapping the insulating body and forming a mating cavity with the tongue;

two rows of terminals, fixedly disposed on the insulating body and exposed on the tongue, wherein one of the two rows of terminals comprises at least one ground terminal, and each of the at least one ground terminal has a retaining portion; and a middle shielding sheet, disposed on the insulating body and located between the two rows of terminals, wherein the middle shielding sheet defines a plane parallel to the retaining portion, wherein each of the at least one ground terminal has an extending portion, the extending portion extends away from the middle shielding sheet and abuts the metal shell, the extending portion extends from the retaining portion, and the extending portion is perpendicular to the plane and extends away from the plane to abut the metal shell.

17. The electrical connector according to claim 16, wherein the metal shell has an inner surface, the inner surface faces and surrounds the insulating body, and the extending portion is in rigid contact with the inner surface.

18. The electrical connector according to claim 17, wherein:

an elastic buckling portion is formed on the inner surface, the insulating body is concavely provided with a buckling slot, and the elastic buckling portion enters the buckling slot; and the insulating body defines a width direction, and an abutting location between the elastic abutting arm and the extending portion and the elastic buckling portion are located on a horizontal sectional plane extending in the width direction.

19. The electrical connector according to claim 16, wherein an abutting portion extends from the middle shielding sheet, an end of the abutting portion is in abutting contact with the metal shell, and a direction in which the abutting portion is in abutting contact with the metal shell and with a direction in which the extending portion is in abutting contact with the metal shell form an angle greater than 0°.

20. The electrical connector according to claim 19, wherein the end of the abutting portion has a strip connecting portion connected to a strip, a width of the strip connecting portion is smaller than the width of the abutting portion, and the strip connecting portion is provided to protrude out of other portions of the end of the abutting portion.

* * * * *